US012296215B2

(12) United States Patent
Jezwinski

(10) Patent No.: US 12,296,215 B2
(45) Date of Patent: May 13, 2025

(54) RESISTANCE BANDS APPARATUS

(71) Applicant: Travis Jezwinski, Littleton, CO (US)

(72) Inventor: Travis Jezwinski, Littleton, CO (US)

( * ) Notice: Subject to any disclaimer, the term of this patent is extended or adjusted under 35 U.S.C. 154(b) by 188 days.

(21) Appl. No.: 18/085,598

(22) Filed: Dec. 21, 2022

(65) Prior Publication Data

US 2023/0256286 A1 Aug. 17, 2023

Related U.S. Application Data

(63) Continuation-in-part of application No. 17/669,620, filed on Feb. 11, 2022, now Pat. No. 11,833,384.

(51) Int. Cl.
*A63B 21/055* (2006.01)
*A63B 21/04* (2006.01)

(52) U.S. Cl.
CPC ..... *A63B 21/0557* (2013.01); *A63B 21/0442* (2013.01)

(58) Field of Classification Search
CPC ..... A63B 21/0557; A63B 21/0442; A63B 21/00043; A63B 23/1209; A63B 21/00185; A63B 2225/09; A63B 21/00065; A63B 21/0414; A63B 21/0555; A63B 21/4035; A63B 21/0552
See application file for complete search history.

(56) References Cited

U.S. PATENT DOCUMENTS 5,885,196 A * 3/1999 Gvoich ..... A63B 21/00185 482/125
7,377,886 B2 * 5/2008 Wu ..... A63B 21/00043 482/121
7,819,787 B2 * 10/2010 Kassel ..... A63B 21/00185 482/121
7,914,426 B1 * 3/2011 Lie ..... A63B 23/14 482/121
D639,355 S * 6/2011 Kassel ..... D21/662
8,152,703 B1 * 4/2012 Hinds ..... A63B 21/00065 482/122
8,317,667 B1 * 11/2012 Thomas ..... A63B 21/0421 482/121
8,491,446 B2 * 7/2013 Hinds ..... A63B 21/4021 482/8
8,602,952 B1 * 12/2013 Cruz ..... A63B 23/0355 482/121
D777,850 S * 1/2017 Kaye ..... D21/692
9,555,278 B2 * 1/2017 Kaye ..... A63B 23/03541
9,555,280 B2 * 1/2017 Kaye ..... A63B 23/03508
9,682,267 B2 * 6/2017 Kaye ..... A63B 23/03541
9,724,553 B2 * 8/2017 Kaye ..... A63B 21/4043
10,486,013 B2 * 11/2019 Wallander ..... A63B 21/0724
D918,319 S * 5/2021 Xu ..... D21/679
(Continued)

*Primary Examiner* — Andrew S Lo

(57) ABSTRACT

The present disclosure provides a resistance band apparatus which overcomes the problems traditionally associated with resistance training—time consuming resistance changes during the same exercise, time consuming adjustments between different exercises, and non-uniform resistance through the exercise motion depending on the height and limb length of the person—by incorporating multiple bands of different resistances into a single apparatus and the bands can be engaged or disengaged from contributing towards the total resistance provided during an exercise.

14 Claims, 7 Drawing Sheets

(56) References Cited

U.S. PATENT DOCUMENTS

| | | | | |
|---|---|---|---|---|
| 2007/0207904 | A1* | 9/2007 | Wu | A63B 21/0004<br>482/126 |
| 2015/0133276 | A1* | 5/2015 | Kaye | A63B 21/055<br>482/129 |
| 2016/0287922 | A1* | 10/2016 | Baudhuin | A63B 21/012 |

* cited by examiner

RESISTANCE BANDS APPARATUS

CROSS REFERENCE TO RELATED APPLICATIONS

This patent application claims the benefit of U.S. non-provisional application Ser. No. 17/669,620, filed 11 Feb. 2022.

FIELD OF INVENTION

The present invention relates generally to a resistance band apparatus. More specifically, the present invention relates to a resistance band apparatus comprising of multiple bands of preset resistance profiles which can be attached and detached to anchor systems and dynamically provide different lengths of the apparatus band structure, depending on the exercise as well as user height and general limb length, and also dynamically switch between different resistances, quickly and efficiently.

BACKGROUND

The advantages of resistance bands in strength and conditioning training are well known, and their use has grown exponentially in recent years with more people desiring to have a legitimate home workout option, as well as many top personal trainers incorporating them heavily into their routines. Bands provide a fantastic combination of portability, flexibility, safety, and exercise efficiency, allowing a user to perform a wide range of motions and exercises by stretching the length of the elastic in the bands away from a designated fixed anchor point to which the bands are attached during a particular exercise.

Traditionally, tube style bands have comprised a single standard-length of elastic with handles on each end. When in use, the middle of the band would either be put around an anchor or stood upon while an exercise was performed with the handles. Each band has a different resistance, which is predicated on the thickness of the length of elastic. Thus, when a user wants to change resistances, they must use a different band set with handles, or switch out or add individual bands to the same set of handles, to achieve the desired resistance. In recent years, varying resistances of standard-length tubes are able to attach, and detach via carabiners, from a common set of handles. This allows not only various resistances of single bands to be switched, but also, for multiple bands to be attach to the common handles, for greater resistance than any of the single bands.

There are several major issues with resistance band training which still deter some users from favoring them over standard free weightlifting or lifting with machines.

Firstly, the requirement of switching between different resistances is time consuming and cumbersome, because the user has to switch the entire band and handles out, or unhook bands from the common set of handles, and then get back into the exercise position they were in and try to get anchored as they were for the particular exercise. The constant switching between various bands, between various exercises, makes it very difficult to keep track of which band, or bands, were used with each exercise, making it difficult to track performance and progress systematically. This constant time-consuming switching makes it difficult to perform exercises with minimal rest between exercise sets, which is desirable.

Secondly, the inability to alter the length of the bands, given they are fixed lengths, and working with a typical fixed anchor point limits the ability of resistance bands to adapt to users of different heights and limb lengths, and to different exercises. Since the bands will flex more or less per exercise depending on if one is a taller or shorter person or has longer or shorter legs/arms (limbs), it is difficult for a user to ensure they are using consistent resistance per exercise, which in turn also makes it more difficult to track performance and progress. Given the fixed lengths of bands, a shorter person, is often forced to not use the provided handles, but rather, try to grip the elastic tubes themselves, in order to have resistance throughout the entire motion of the exercise, which is a significant inconvenience as well as far less grip to perform the exercise.

While there have been many developments in resistance band systems in recent years, there are no solutions to solve the aforementioned problems. It is within this context that the present invention is provided.

SUMMARY

The present disclosure provides a resistance band apparatus which overcomes the problems traditionally associated with resistance training—time consuming resistance changes during the same exercise, time consuming adjustments between different exercises, and non-uniform resistance through the exercise motion depending on the height and limb length of the person—by incorporating multiple bands of different resistances into a single apparatus and the bands can be engaged or disengaged from contributing towards the total resistance provided during an exercise.

Thus, according to one aspect of the present disclosure there is provided a A resistance band apparatus, comprising: a handle; a resistance band holder coupled to the handle, the resistance band holder having a plurality of openings of a first diameter formed therein, each configured to receive and hold a resistance band; a number of resistance bands corresponding to the plurality of openings, each resistance band comprising a length of elastic material having bulbed ends, the bulbed ends having a second diameter greater than the first diameter.

The apparatus of the first aspect further comprises a band support housing, the band support housing comprising a hollow body having a first open end and a second closed end, the second closed end having an opening through which a coupling element is threaded, the housing further comprising a locking element within at a fixed point along the length of the body, the locking element having a corresponding number of openings of a diameter smaller than the second diameter, and thereby each being configured to receive and lock a bulbed end of a respective resistance band within the housing between the second closed end and the locking element; a carabiner coupled to the locking element via the coupling element threaded through the opening of the band support housing; and a length of webbing having one or more D-rings disposed along its length to couple to the carabiner, each D-ring having a corresponding label.

In some embodiments, the openings of the band holder are slanted such that the diameter increases from the first diameter to a larger diameter, allowing the bulbed ends of the resistance bands to rest within.

In some embodiments, the locking element is a removable disc that slots into a groove along an inner wall of the housing body.

In some embodiments, the apparatus further comprises a second locking element that affixes to a point within the housing body along its length between the first open end and the first locking element, the second locking element having a corresponding plurality of openings for keeping the lengths of the resistance bands straight within the housing body.

In some embodiments, the housing body is formed of two pieces connected along one edge by a hinged joint and on another second edge by a locking mechanism.

In some embodiments, each resistance band is configured with a thickness to provide a set profile of elastic resistance to deformation by stretching which is different from each other resistance band of the apparatus.

In such embodiments, the thickness and thus level of resistance provided by each resistance band is indicated by a marking or coloration of the band. Furthermore, the housing body may have a corresponding plurality of markings about its exterior, each marking indicating the resistance level of a respective band. Furthermore, the band holder may have a plurality of colored markings corresponding to and adjacent to each opening, each marking indicating the resistance level of a respective band to be inserted.

In some embodiments, the openings of the band holder are configured to receive the resistance bands by having a gap in the circumference of each opening, the width of the gaps being smaller than the first diameter but greater than the un-bulbed portions of each resistance band.

In some embodiments, the handle comprises a plastic tunnel grip having a length of nylon webbing looped through, the nylon webbing being coupled to the band holder.

According to second aspect of the present disclosure, there is provided a resistance band apparatus, comprising: a handle; a first carabiner coupled to the handle; two or more resistance bands, each resistance band comprising a length of elastic material having a first O-ring disposed at a first end of the length of elastic which is configured to detachably couple to the first carabiner and a second O-ring at the opposing end; a second carabiner coupled to the second O-ring of each resistance band; and a length of webbing having a first D-ring at one end of the length which attaches to the second carabiner and one or more second D-rings that are attached to a nylon strap disposed along its length to couple to the second O-rings of the resistance bands, each D-ring having a corresponding label.

Each resistance band is configured with a thickness to provide a set profile of elastic resistance to deformation by stretching which is different from each other resistance band of the apparatus, the thickness and thus level of resistance provided by each resistance band being indicated by a distinct marking and coloration of the band.

In some embodiments, the apparatus further comprises a sheath, or clear tube, configured to enclose and hold together each of the resistance bands when exercising, and, when not exercising.

The sheath may be a piece of nylon fabric provided with hook and loop elements to detachably wrap around the two or more resistance bands, or alternatively, it may be a clear plastic tube, either of which will enclose and hold the resistance bands together.

In some embodiments, the first and/or second end of the elastic length of each resistance band is attached to the second O-ring by a webbing loop. The coupling between the length of elastic and the webbing loop may be formed by passing the elastic length through a grommet that overlaps the ends of the nylon loop, holding it together, the elastic length of each resistance band having a thicker profile at the end(s) so as to have a greater diameter than the width of the opening of the grommet(s).

In some embodiments, the handle comprises a plastic tunnel grip having a length of nylon webbing looped through, and the nylon webbing couples to the first carabiner.

In some embodiments, the apparatus comprises five resistance bands of different colors and resistances, such that a user may control the total resistance level provided by the apparatus on a scale of 1-15 by attaching different numbers of the first O-rings, which are affixed to the bands, to the first carabiner, which is attached to the handle of the apparatus.

In some embodiments, the D-rings on the length of nylon webbing are evenly spaced from one another and labelled numerically to provide users with a range of length settings which are uniform and easily recorded, as they are attached to variations of fixed anchors, typically hooks, for each exercise.

In some embodiments, the length of webbing having the D-rings disposed along its length is a single piece of nylon wrapped around in a loop with the ends meeting in the middle. The loop is provided with box stitching along its length to form a solid strap.

BRIEF DESCRIPTION OF THE DRAWINGS

Various embodiments of the invention are disclosed in the following detailed description and accompanying drawings.

Figures 1, 2:
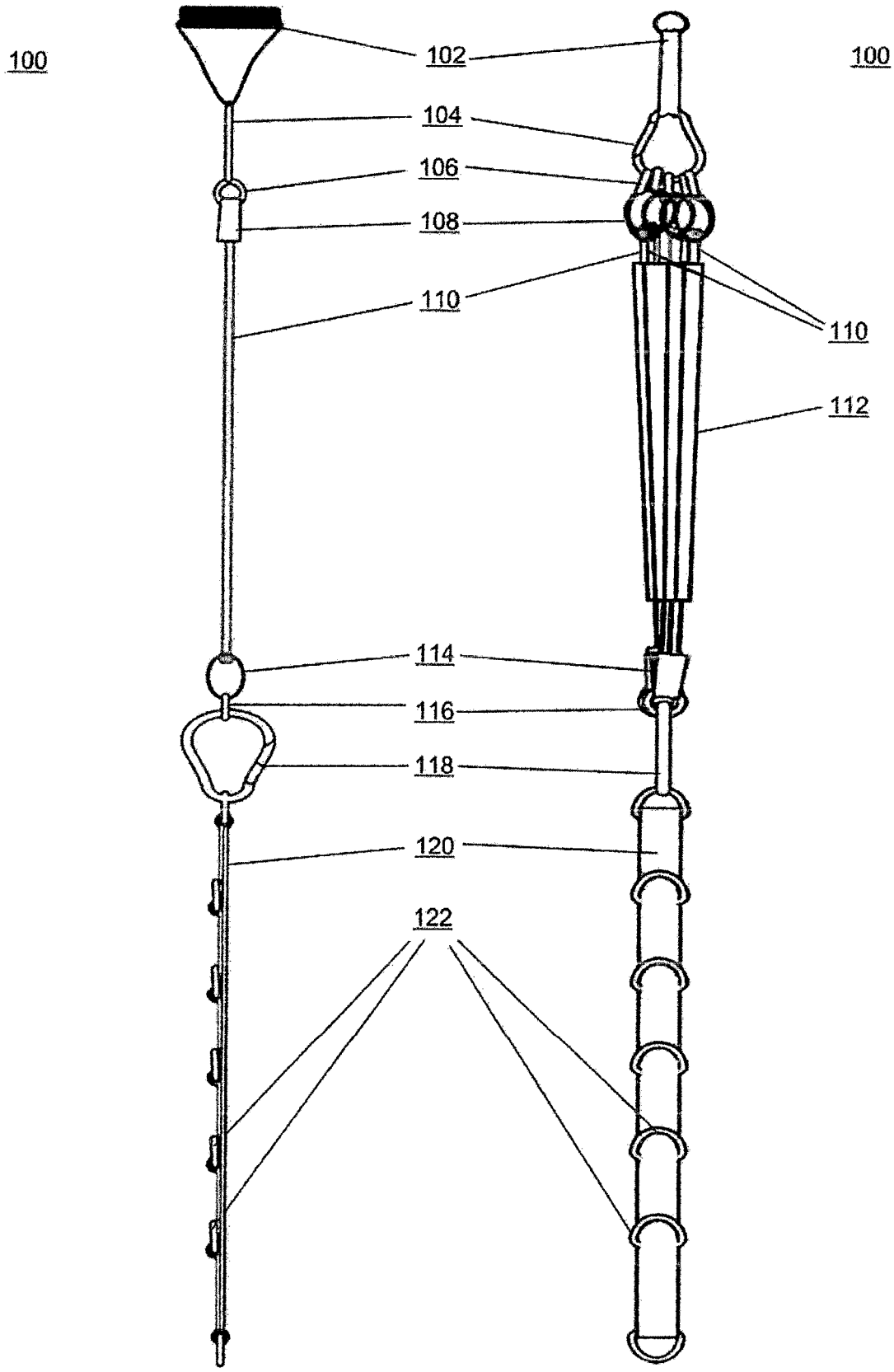
FIG. 1 illustrates an isometric side view of a first example configuration of a resistance band apparatus according to the present disclosure.
FIG. 2 illustrates an isometric front view of the first example configuration of a resistance band apparatus according to the present disclosure.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Definitions

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting. As used herein, the singular forms "a," "an" and "the" are intended to include the plural forms as well, unless the context clearly indicates otherwise.

Spatially relative terms, such as "under," "below," "lower," "over," "upper" and the like, may be used herein for ease of description to describe one element or feature's relationship to another when the apparatus is right side up.

The terms "first," "second," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

The present disclosure provides two example configurations of a resistance band apparatus utilising novel concepts to overcome the problems traditionally associated with resistance band training as set out above, facilitating quick and easy switching between different levels of resistance and providing uniform lengths from a fixed anchor point to achieve consistent ranges of motion, regardless of user height and limb length. Both example configurations share a number of innovative features that provide synergistic improvements over the prior art.

First Embodiment

Referring to FIG. 1 and FIG. 2, a side view and front view of a first example configuration of a resistance band apparatus 100 according to the present disclosure is shown.

The apparatus 100 together forms a chain of linked components, with the plurality of resistance bands being a middle link in that chain that can be varied by attaching/detaching them. At a first end of the chain is a handle 102 the user holds during a resistance exercise. The handle 102 is generally formed of a plastic tunnel grip with a nylon (or other strong fabric) loop threaded through it. This in turn is coupled to a first carabiner 104, which is connected to one or more of the resistance bands 110 by an O-ring 106 and second nylon loop 108 arrangement in the present example. Each resistance band has such an arrangement on each end of its length in the illustrated configuration.

A more detailed example configuration of the coupling between the elastic length of the resistance bands 110 and the O-rings is provided below with reference to FIGS. 4 and 5. A person of skill in the art will recognize that alternative configurations may be used to achieve the same effects, as long as the resistance bands are each able to quickly couple or decouple from the first carabiner 104 to alter the total resistance provided by the apparatus.

In the present example, the apparatus 100 comprises five resistance bands 110 of different thickness, color coded to indicate the amount of resistance they contribute to elongation. The opposing end of each band is always couple to a second carabiner 118, in this example by a second nylon loop 114 and O-ring 116 arrangement. However, the bands are designed to be coupled and decoupled from the first carabiner to tailor the amount of total resistance to a user's needs quickly and easily. Thus, while all five bands 110 will always be attached to the apparatus, not all of them need be "engaged". The apparatus 100 may thus also comprise a sheath 112 to hold the bands 110 together during exercises, keeping the O-rings 106 together even when disengaged so that they can be quickly attached for the next exercise.

In the other examples the bands may be labelled or otherwise marked to indicate their resistance level in place of color coding. The inventor of the present application envisages a system where each band is represented by or corresponds to a number, for example between 1 and 5 for five bands, which can then allow a user to add or subtract bands of different numbers to reach predefined resistance levels allowing them to easily track their progress. For example, the strongest band 5 plus the weakest band 1 would equate to a total resistance level of 6, and so on and so forth.

The second carabiner 118 is coupled to a strap or length of webbing 120 which has D-rings 122 disposed at various points along its length. Generally, there will be a first proximal D-ring at one end of the length to which the second carabiner 118 is attached in the default state, and then additional D-rings evenly spaced along the rest of the length of the webbing 120 to which the carabiner may be moved to vary the total length of the apparatus 100 for different exercises or any of the D rings along the strap webbing 120 can hook to an anchor during an exercise.

The D-ring 122 at the opposing end of the webbing 120 would then be hooked onto an anchor point from which the user would pull the handle, stretching the engaged resistance bands 110 and pulling against their combined elastic tension.

Figure 3:
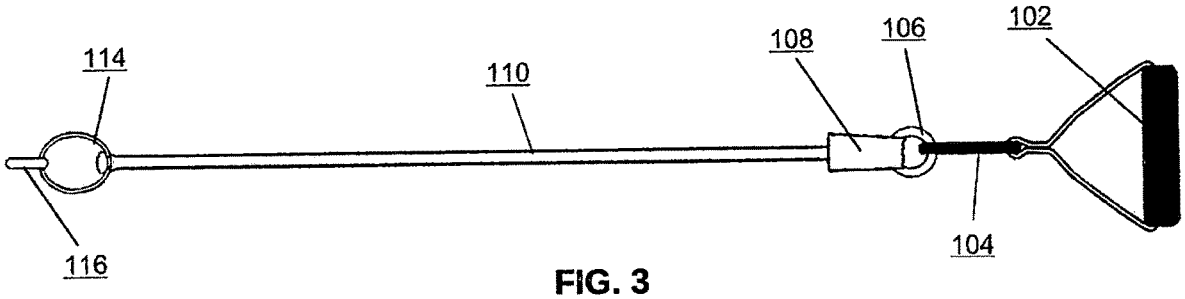
FIG. 3 illustrates an isometric view of the resistance band and handle of the first example configuration for use in the disclosed apparatus.

Referring to FIG. 3, an isometric view of the resistance bands 110 attached to the handle 102 is shown. This part of the apparatus 100 can easily be detached from the second carabiner 118 if desired, making it more portable.

Figure 4:
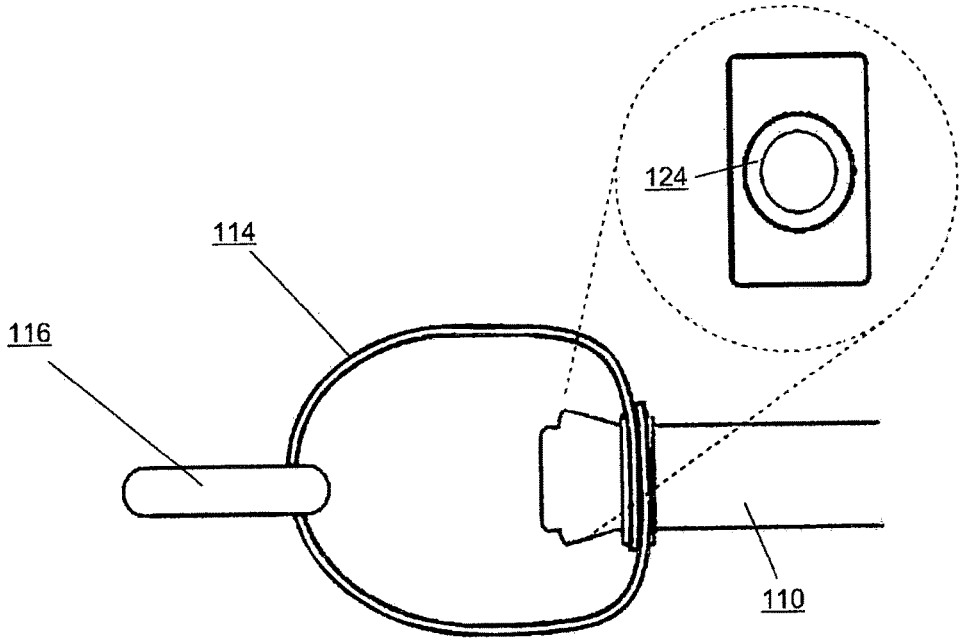
FIG. 4 illustrates a close-up view of the first example configuration of a coupling between the elastic length of a resistance band and an O-ring.
Figure 5:
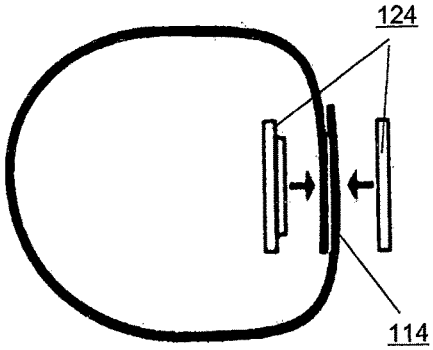
FIG. 5 illustrates an exploded view of the components of the coupling shown in FIG. 4.

Referring to FIG. 4 and FIG. 5 a close-up view and exploded view of an example configuration of a coupling between the elastic length of a resistance band 110 and an O-ring 116 is shown. This type of coupling can be used between each end of each resistance band and the first and second O-rings mentioned above, but other configurations can also be used.

In the example configuration, the nylon loop 114 is formed of a single strip with openings at either end. This strip is wrapped around into a loop with the openings each overlaid with one another and a two-piece grommet 124 sandwiches them together, forming the nylon loop. The elastic length of the resistance band 110 can then be threaded through the opening of the grommet 124, and if the end of the elastic length is thicker than the diameter of the grommet 124 opening then this will from a secure connection. The nylon loop 114 is also threaded through the opening of the O-ring 116, 106, before the grommet 124 is applied, forming a secure connection between the O-ring and the length of elastic 110.

Second Embodiment

A drawback associated with the configuration of the first embodiment is that each end of each resistance band must be coupled to a carabiner by a separate O-ring, which can be heavy and make it fiddly for the user to engage/disengage the correct bands.

Another drawback is that in the course of engaging/disengaging bands between exercises, a user may easily tangle resistance bands with one another or mix up the order in which the bands are coupled to the carabiners. Tangled bands can be frustrating for the user, and changes in the coupling order can lead to small discrepancies in resistance consistency, as it changes the respective points at which each band begins to stretch and provide resistance, albeit by small margins.

In light of the above, the inventor of the present disclosure has developed a second configuration which overcomes these issues, while utilising many of the same core innovative concepts applied in the first configuration.

Figures 6, 7:
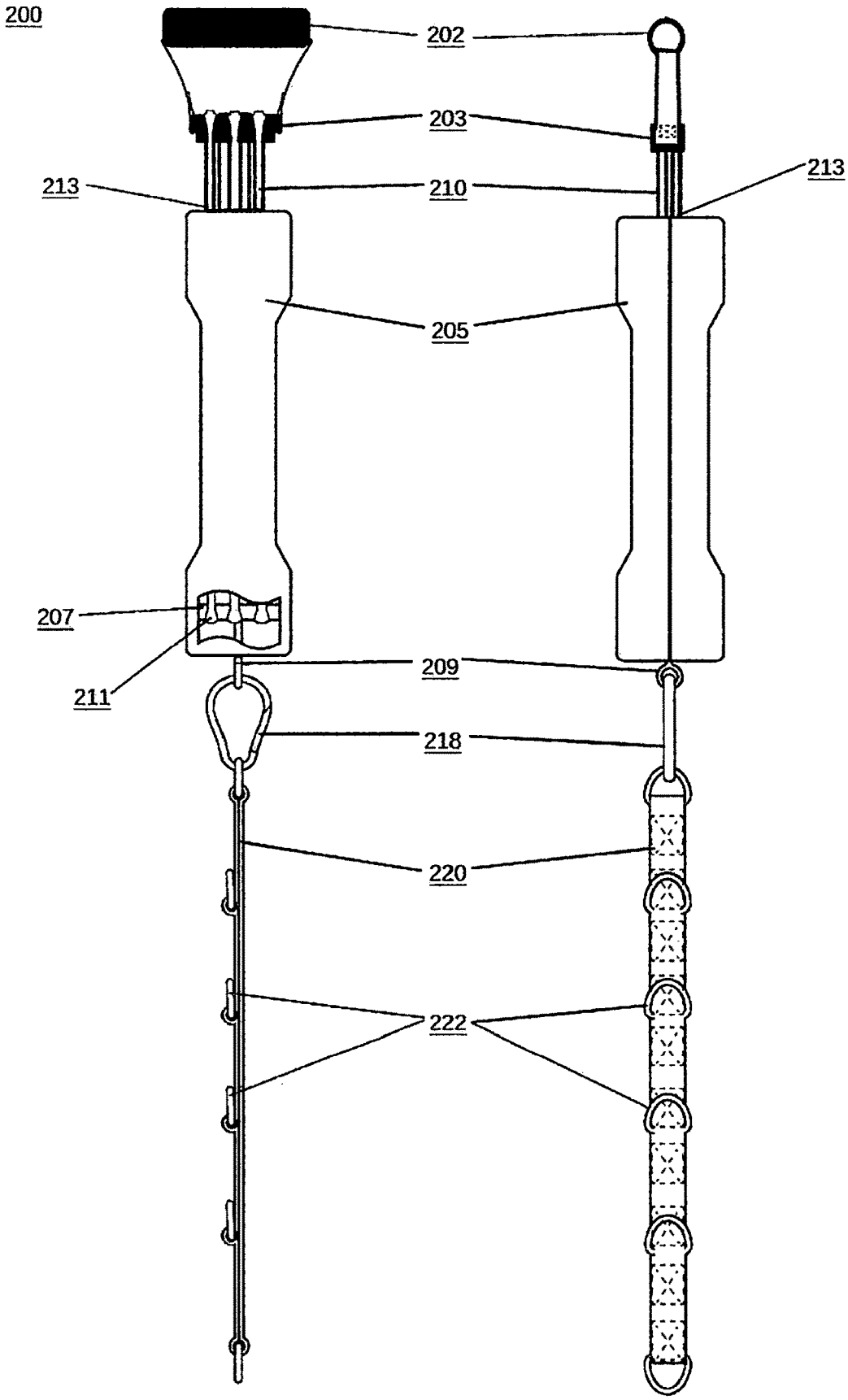
FIG. 6 illustrates an isometric side view of a second example configuration of a resistance band apparatus according to the present disclosure.
FIG. 7 illustrates an isometric front view of the second example configuration of a resistance band apparatus according to the present disclosure.

Referring to FIG. 6 and FIG. 7, front and side views of a second example configuration of a resistance band apparatus 200 are shown.

As with the first configuration, the apparatus 200 comprises a handle 202 which is coupled to a set of resistance bands 210 that can be engaged or disengaged to control the total resistance when pulling the handle 202 away from an anchor point. The anchoring mechanism is also the same, with a carabiner 218 coupled to a strap or length of webbing 220 which has D-rings 222 disposed at various points along its length.

The difference from the first configuration lies in the coupling mechanism between the handle 202 and the carabiner 218, and how the bands 210 are engaged and disengaged.

In this example, the handle 202 is coupled to a band holder 203. The resistance band holder 203 has a plurality of openings of a first diameter formed therein, each configured to receive and hold a resistance band. The band holder is shown and described in more detail with reference to FIG. 12 and FIG. 13, but in general the coupling is achieved by having resistance bands 210 with bulbed ends 211 which cannot fit through the openings.

The lengths of the resistance bands 210 are enclosed in a band support housing 205. This is a hollow body made of a sturdy material such as plastic. It has a first open end 213 which faces the handle and an opposing closed end with an opening through which an eye bolt 209 is threaded through into the housing. The eye bolt 209 is then coupled to locking element 207 so that the bands 210 are applying pressure to the locking element one way via the bulbed ends and the eye bolt 209 and carabiner 218 are pulling it the other way.

Internally, the support housing 205 has at least one locking element 207, which can be affixed within the housing 205 at a set point along its length, and which has a set of openings similar to those of the bands holder, which lock the opposing ends of the bands 210, which are also bulbed, within the housing 205. Again, this is done by having the bulbed ends of the resistance bands 210 be too large to fit through the openings of the locking element 207.

The bulbed ends 211 of the resistance bands 210 may in some examples be provided with gripping points which are thinner than the bulbed portion to allow a user to easily pull them out of the resistance band holder.

Figure 8:
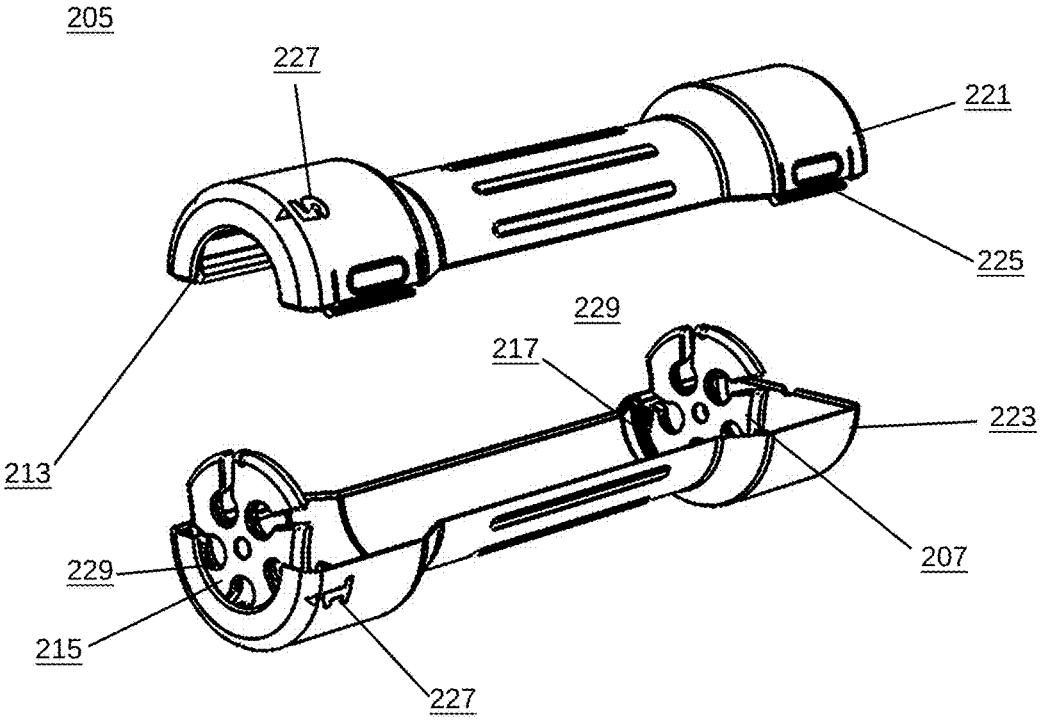
FIG. 8 illustrates a first isometric components view of a band support housing of the second example configuration with the locking elements affixed in place within.
Figure 9:
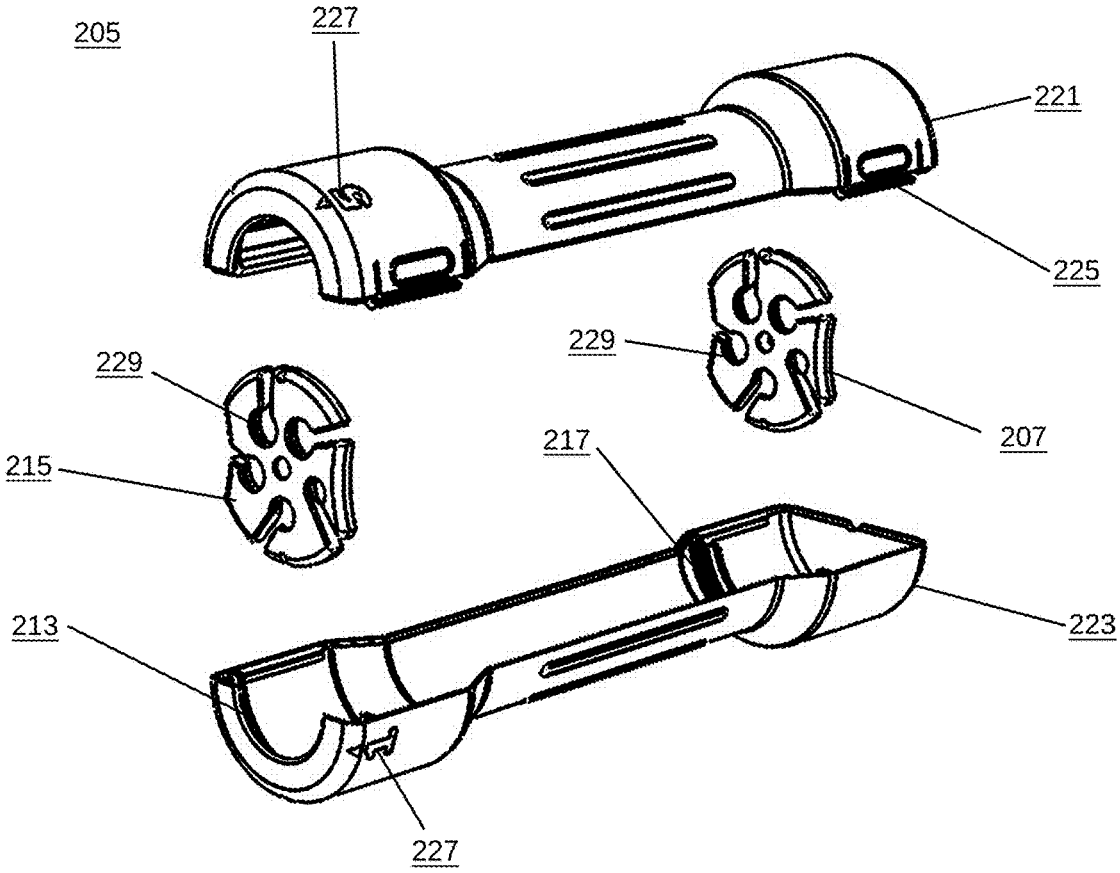
FIG. 9 illustrates a second isometric components view of the second example configuration with the locking elements removed.
Figure 10:
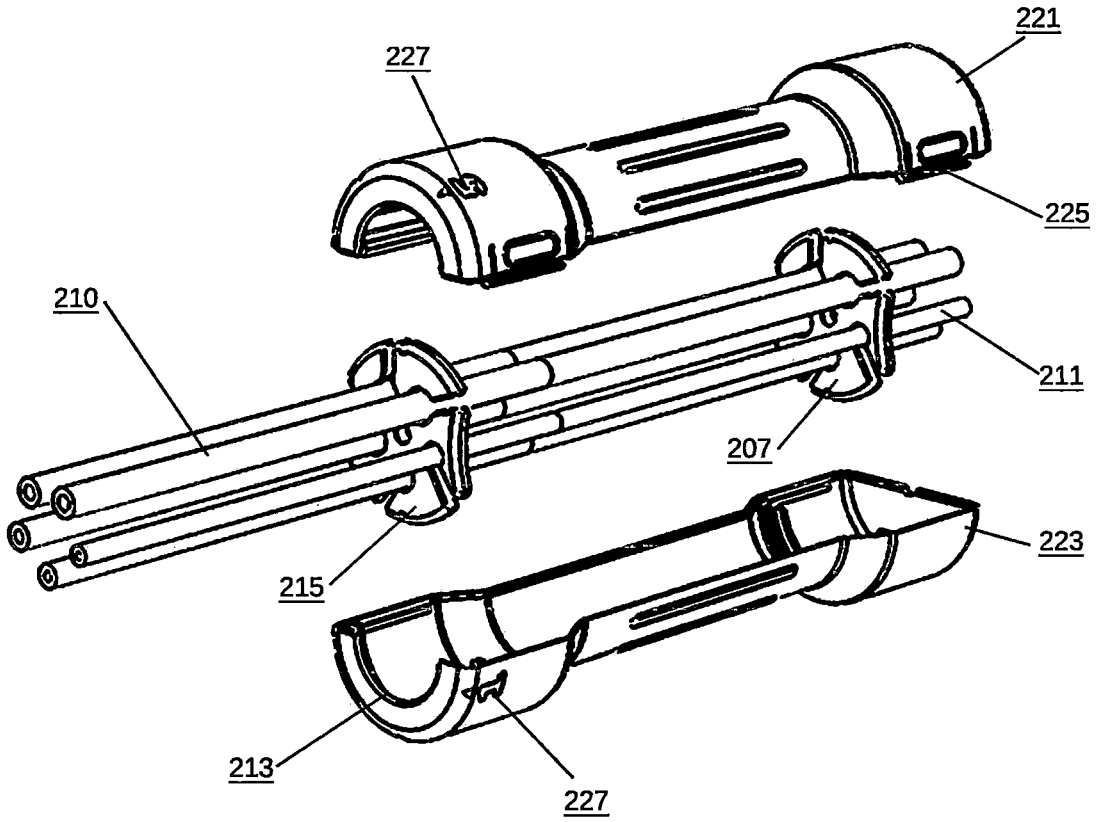
FIG. 10 illustrates a third isometric components view of the second example configuration with a set of resistance bands threaded through the openings of the locking elements.

Referring to FIG. 8, FIG. 9, and FIG. 10, components views are shown of the band support housing 205 with two locking elements installed, with them removed, and with the resistance bands inserted into the openings.

In the present example, the housing body 205 has a cylindrical shape which is formed of a first half 221 and a second half 223. The interior walls of the body have a set of grooves 217 and which affix the locking elements 207 and 215 in place respectively.

The first locking element 207, which is always present, is located at the rear of the housing 205, adjacent to the closed end. The thinner portions of the resistance bands 210 are inserted into the openings 229 of the first locking element 207, hooking the bulbed ends 211 in place between it and the closed end of the housing and thus securing them in place, since the locking element 207 is itself locked into groove 217.

The second locking element 215 is used for organising the resistance bands within the housing 205. It locks in place in a similar groove adjacent to the open end 213 of the housing 205 and has a corresponding set of openings 229 which will when installed be aligned with the opening s 229 of the first locking element. As can be seen in FIG. 10, the effect of this is to keep the lengths of the resistance bands 210 straight and untangled in the interior of the housing 205.

The locking elements are generally removable discs, so that the resistance bands can be installed more easily.

In the present example, the first portion 221 and second portion 223 of the housing coupled together via a locking mechanism—a protrusion 225 on the first portion 221 that clicks into place on a corresponding groove on the second portion. The opposing edge of the two portions may in some examples comprise a hinged joint which allows the housing 205 to be easily opened to remove the locking elements.

In the present example, the exterior of the open end of the housing 205 is also provided with markings 227 which indicate the level of resistance provided by the respective resistance band that is locked into place adjacent to that point of the circumference of the housing 205.

Figure 11:
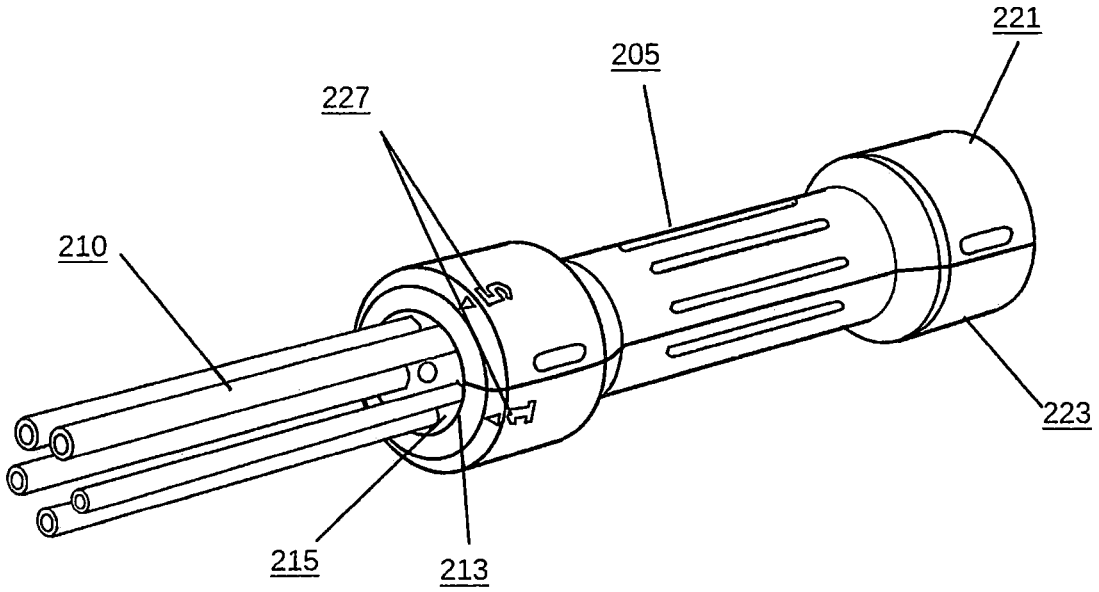
FIG. 11 illustrates a perspective view of the assembled band support housing, resistance bands, and locking elements.

In FIG. 11 the components have all been assembled and the housing 205 is shown as it will appear in use, with respective resistance bands 210 protruding from the open end to be engaged or disengaged with the band holder.

Figure 12:
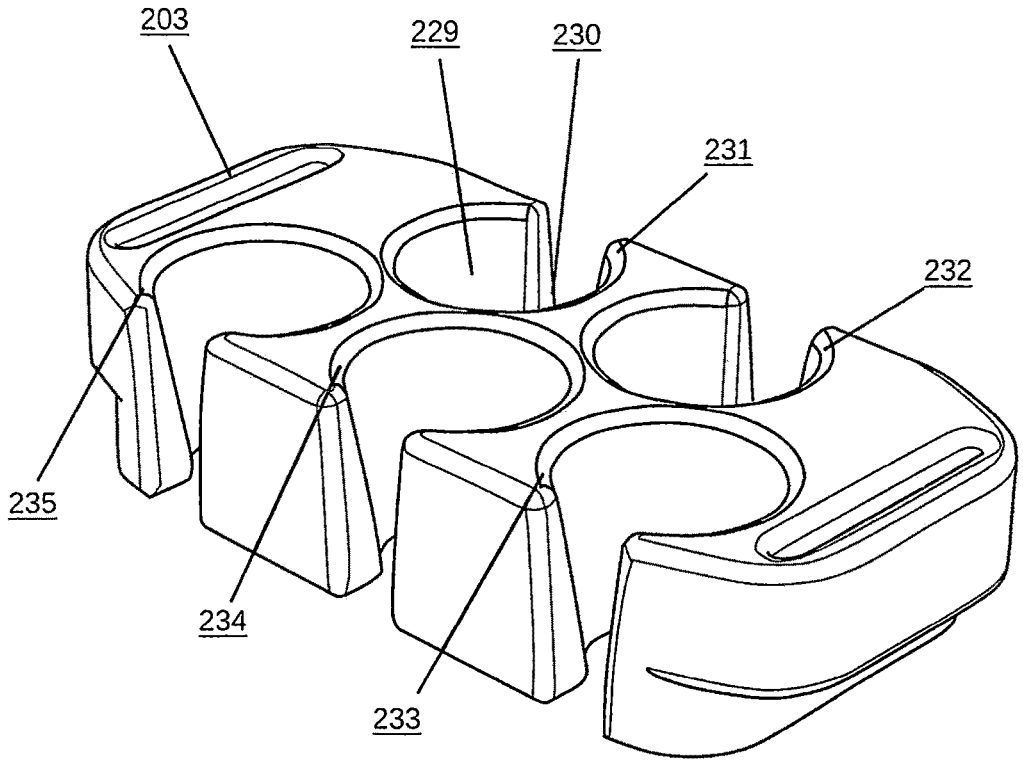
FIG. 12 illustrates a first isometric perspective view of the band holder of the second example configuration.
Figure 13:
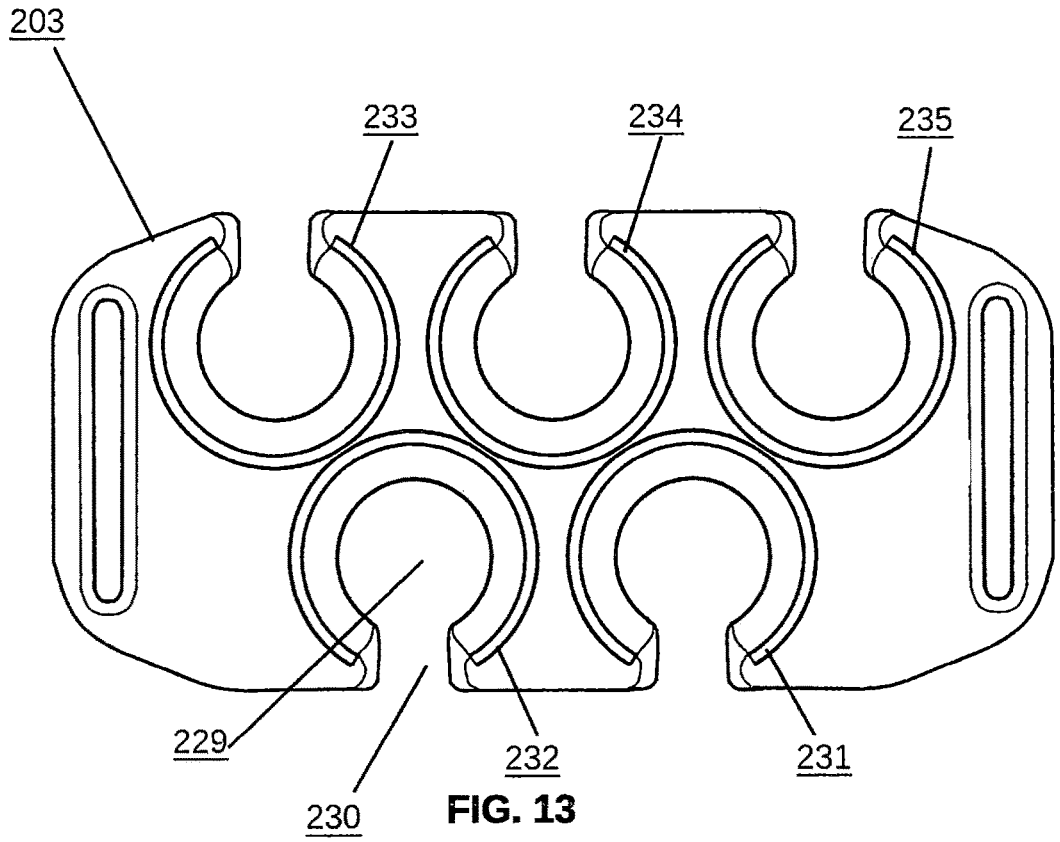
FIG. 13 illustrates a second isometric perspective view of the band holder of the second example configuration.

Referring to FIG. 12 and FIG. 13, perspective views are shown of an example band holder 203 for use with the second example configuration. This band holder 203 would be coupled directly to the handle via the slots on the side or some other means.

As can be seen, the band holder 203 is a flat block with a plurality of openings 229 in it—one opening 229 for each resistance band in the apparatus. As mentioned above, these openings need to be small enough that the bulbed ends of the resistance bands 210 cannot pass through completely, and so are "hooked" into them when engaged. In order to easily insert and remove the bands 210 to engage/disengage them between exercises, the band holder has a gap 230 in the circumference of each opening 229 so that the thinner bodies of the resistance bands can be looped through. This may be complemented by having the openings 229 slant outwards as they get closer to the handle, allowing for portions of the bulbed ends to rest within the openings but not pass through.

In addition to providing an anchor point for the engaged bands, the band holder 203 also acts to position the engaged bands in a consistent way and keep them organised. In the present example there are five resistance bands 210 and thus five openings 229 in the band holder 203. Each opening is provided with a marking 231, 232, 233, 234, 235, which a user can use to determine which band should be engaged where in the holder 203. The markings may simply be color-coded, or may be provided with corresponding numbers.

When engaged in the correct opening 229, a resistance band will maintain a straight profile through both the locking elements in the support housing to the corresponding opening in the band holder, allowing for extremely precise and consistent resistance selection.

Either Embodiment

Figure 14:
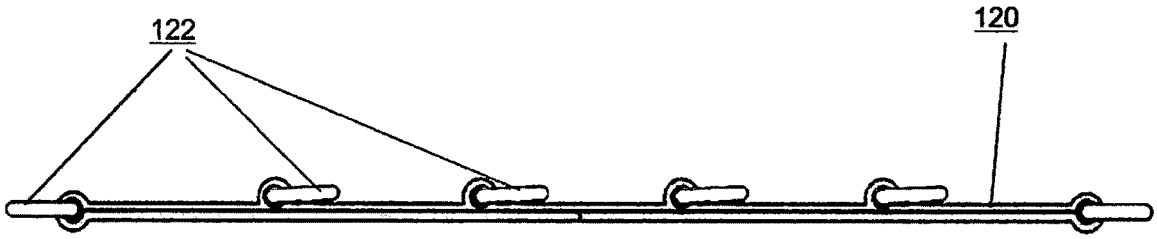
FIG. 14 illustrates a first isometric side view of a length of webbing having D-rings disposed along its length for use in the disclosed apparatus.
Figure 15:
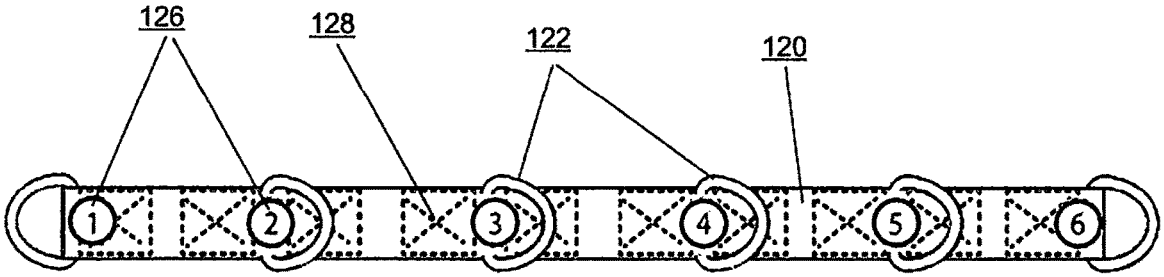
FIG. 15 illustrates a second isometric front view of the length of webbing.

Referring to FIG. 14 and FIG. 15, a side view and a frontal view of a length of webbing 120 having D-rings 122 disposed along its length is shown in more detail. This part of the apparatus is the same for both example configurations.

The webbing 120 has D-rings disposed at either end and four other D-rings disposed evenly along its length, for a total of 6. Each D-ring 122 is thus labelled with a number 126 between 1 and 6, allowing a user to quickly recognized and record which length they are setting the carabiner 118 at for a given exercise, which is useful for achieving consistent ranges of motion for each user of different heights and limb lengths, and for each particular exercise and given anchor position, and gaining more insight into performance and improvement in different exercises over a time period.

The webbing 120 in the present example is formed of a single long strip of nylon which has been wrapped over itself with the opposing ends meeting in the middle of the rear surface, and then cross stitching 128 has been applied to form it into a reinforced strap.

The D-rings, and the O-rings mentioned above, are generally formed of steel or another suitably resilient material.

Figure 16:
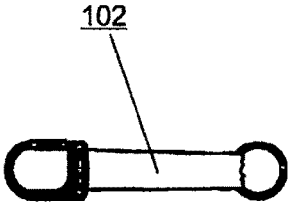
FIG. 16 illustrates an isometric side view of an example handle for use in disclosed apparatus.

Referring to FIG. 16, an example handle 102 for use in the disclosed apparatus is shown. As mentioned above, the handle 102 is generally formed of a plastic tube with a nylon loop threaded through and may also comprise another coupling mechanism such as a clip for attaching to the first carabiner 104 or a pair of loops for engaging with the resistance band holder 203.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the resistance band apparatus have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A resistance band apparatus, comprising:

a handle;

a resistance band holder coupled to the handle, the resistance band holder having a plurality of openings of a first diameter formed therein, each configured to receive and hold a resistance band;

a number of resistance bands corresponding to the plurality of openings, each resistance band comprising a length of elastic material having bulbed ends, the bulbed ends having a second diameter greater than the first diameter;

a band support housing, the band support housing comprising a hollow body having a first open end and a second closed end, the second closed end having an opening through which a coupling element is threaded-, the housing further comprising a locking element within at a fixed point along the length of the body, the locking element having a corresponding number of openings of a diameter smaller than the second diameter, and thereby each opening being configured to receive and lock a bulbed end of a respective resistance band within the housing between the second closed end and the locking element;

a carabiner coupled to the locking element via the coupling element threaded through the opening of the band support housing; and a length of webbing having one or more D-rings disposed along its length to couple to the carabiner, each D-ring having a corresponding label.

2. A resistance band apparatus according to claim 1, wherein the openings of the band holder are slanted such that the diameter increases from the first diameter to a larger diameter, allowing the bulbed ends of the resistance bands to rest within.

3. A resistance band apparatus according to claim 1, wherein the locking element is a removable disc that slots into a groove along an inner wall of the housing body.

4. A resistance band apparatus according to claim 1, further comprising a second locking element that affixes to a point within the housing body along its length between the first open end and the first locking element, the second locking element having a corresponding plurality of openings for keeping the lengths of the resistance bands straight within the housing body.

5. A resistance band apparatus according to claim 1, wherein the housing body is formed of two pieces connected along one edge by a hinged joint and on another second edge by a locking mechanism.

6. A resistance band apparatus according to claim 1, wherein each resistance band is configured with a thickness to provide a set profile of elastic resistance to deformation by stretching which is different from each other resistance band of the apparatus.

7. A resistance band apparatus according to claim 6, wherein the thickness and thus level of resistance provided by each resistance band is indicated by a marking or coloration of the band.

8. A resistance band apparatus according to claim 6, wherein the housing body has a corresponding plurality of markings about its exterior, each marking indicating the resistance level of a respective band.

9. A resistance band apparatus according to claim 6, wherein the band holder has a plurality of colored markings corresponding to and adjacent to each opening, each marking indicating the resistance level of a respective band to be inserted.

10. A resistance band apparatus according to claim 1, wherein the openings of the band holder are configured to receive the resistance bands by having a gap in the circumference of each opening, the width of the gaps being smaller than the first diameter but greater than the un-bulbed portions of each resistance band.

11. A resistance band apparatus according to claim 1, wherein the handle comprises a plastic tunnel grip having a length of nylon webbing looped through, the nylon webbing being coupled to the band holder.

12. A resistance band apparatus according to claim 1, wherein the D-rings on the length of webbing are evenly spaced from one another and labelled numerically to provide users with a range of length settings which are uniform and recordable.

13. A resistance band apparatus according to claim 1, wherein the length of webbing having the D-rings disposed along its length is a single piece of nylon wrapped around in a loop with the ends of the single piece of nylon meeting in the middle.

14. A resistance band apparatus according to claim 13, wherein the loop is provided with box stitching along its length to from a solid strap.

* * * * *